US011796252B2

(12) United States Patent
Taniguchi et al.

(10) Patent No.: US 11,796,252 B2
(45) Date of Patent: Oct. 24, 2023

(54) CONTINUOUS HEATING FURNACE AND OPERATING METHOD THEREOF

(71) Applicant: NGK INSULATORS, LTD., Nagoya (JP)

(72) Inventors: Satoshi Taniguchi, Nagoya (JP); Takeshi Tokunaga, Nagoya (JP)

(73) Assignee: NGK INSULATORS, LTD., Nagoya (JP)

( * ) Notice: Subject to any disclaimer, the term of this patent is extended or adjusted under 35 U.S.C. 154(b) by 892 days.

(21) Appl. No.: 16/540,295

(22) Filed: Aug. 14, 2019

(65) Prior Publication Data

US 2020/0064069 A1 Feb. 27, 2020

(30) Foreign Application Priority Data

Aug. 22, 2018 (JP) ..... 2018-155532

(51) Int. Cl.
*F27D 9/00* (2006.01)
*F27B 9/12* (2006.01)
(Continued)

(52) U.S. Cl.
CPC ..... *F27B 9/12* (2013.01); *F27D 3/0021* (2013.01); *F27B 2009/122* (2013.01);
(Continued)

(58) Field of Classification Search
CPC ..... F27B 9/02; F27B 9/30; F27B 9/40; F27B 9/12; F27B 9/028; F27B 13/02;
(Continued)

(56) References Cited

U.S. PATENT DOCUMENTS 4,527,974 A * 7/1985 Carraroli ..... F27B 9/20 432/78
4,767,320 A * 8/1988 Sasaki ..... F27B 9/3005 432/152
(Continued)

FOREIGN PATENT DOCUMENTS

DE 976094 * 2/1963
DE 976094 B 2/1963
(Continued)

OTHER PUBLICATIONS

Japanese Office Action (Application No. 2018-155532) dated Oct. 5, 2021 (with English translation).
(Continued)

*Primary Examiner* — Gregory A Wilson
(74) *Attorney, Agent, or Firm* — BURR PATENT LAW, PLLC

(57) ABSTRACT

A continuous heating furnace including an inlet, a heating zone, a cooling zone and an outlet in this order, for carrying out a heat treatment while conveying at least one workpiece from the inlet to the outlet, wherein the cooling zone is configured such that an ambient gas for direct cooling of the workpiece can flow into the cooling zone from the outlet; the cooling zone includes a plurality of indirect coolers arranged in parallel in the conveying direction of the workpiece, each of the indirect coolers having at least one regulator for independently adjusting a cooling power; and the cooling zone includes one or more residual heat outlets for discharging a residual heat gas in the cooling zone.

13 Claims, 5 Drawing Sheets

(51) Int. Cl.

| | |
|---|---|
| ***F27D 3/00*** | (2006.01) |
| *F27B 9/36* | (2006.01) |
| *F27D 21/00* | (2006.01) |
| *F27D 19/00* | (2006.01) |

(52) U.S. Cl.
CPC . *F27B 2009/124* (2013.01); *F27B 2009/3638* (2013.01); *F27D 21/0014* (2013.01); *F27D 2003/0063* (2013.01); *F27D 2009/0072* (2013.01); *F27D 2019/0003* (2013.01)

(58) Field of Classification Search
CPC .. F27B 9/3011; F27B 9/10; F27D 7/04; F27D 2009/0002; F27D 2009/007
See application file for complete search history.

(56) References Cited

U.S. PATENT DOCUMENTS

| | | | | |
|---|---|---|---|---|
| 5,458,485 | A * | 10/1995 | Righetti | F27B 9/12 266/112 |
| 10,018,421 | B2 * | 7/2018 | Tseng | F27B 9/12 |

FOREIGN PATENT DOCUMENTS

| | | | | |
|---|---|---|---|---|
| EP | 0 178 401 | A2 | | 4/1986 |
| EP | 0 483 960 | A1 | | 5/1992 |
| GB | 2135032 | A | * | 8/1984 |
| JP | H03-023795 | U | | 3/1991 |
| JP | H03-040317 | B2 | | 6/1991 |
| JP | H04-124586 | A1 | | 4/1992 |
| JP | H04-186091 | A1 | | 7/1992 |
| JP | H05-172465 | A | | 7/1993 |
| JP | 2859987 | B2 | | 2/1999 |
| JP | H11-142061 | A1 | | 5/1999 |
| JP | 2007-046073 | A | | 2/2007 |
| JP | 2008-224192 | A | | 9/2008 |

OTHER PUBLICATIONS

Japanese Office Action (Application No. 2018-155532) dated Mar. 2, 2021 (with English translation).
Chinese Office Action (with English translation), Chinese Application No. 201910715836.2, dated Jul. 18, 2022 (18 pages).
German Office Action (with English translation), German Application No. 10 2019 005 858.5, dated Nov. 18, 2022 (12 pages).

* cited by examiner

[FIG. 1]
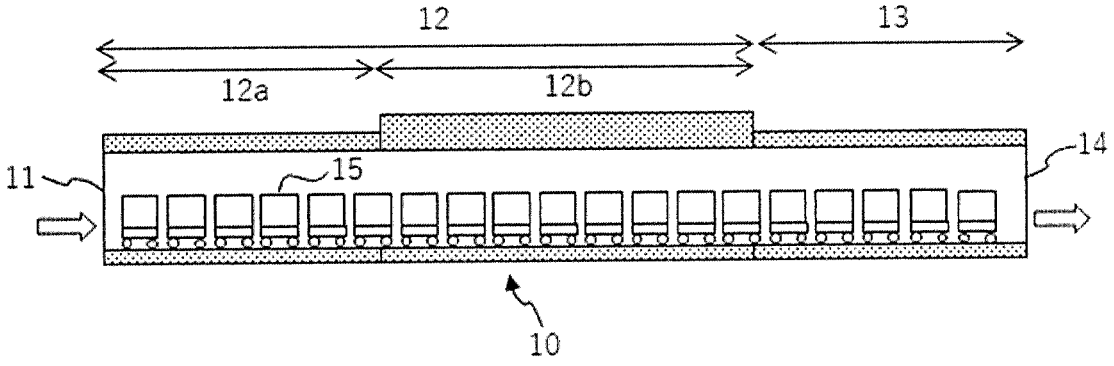

[FIG. 2]
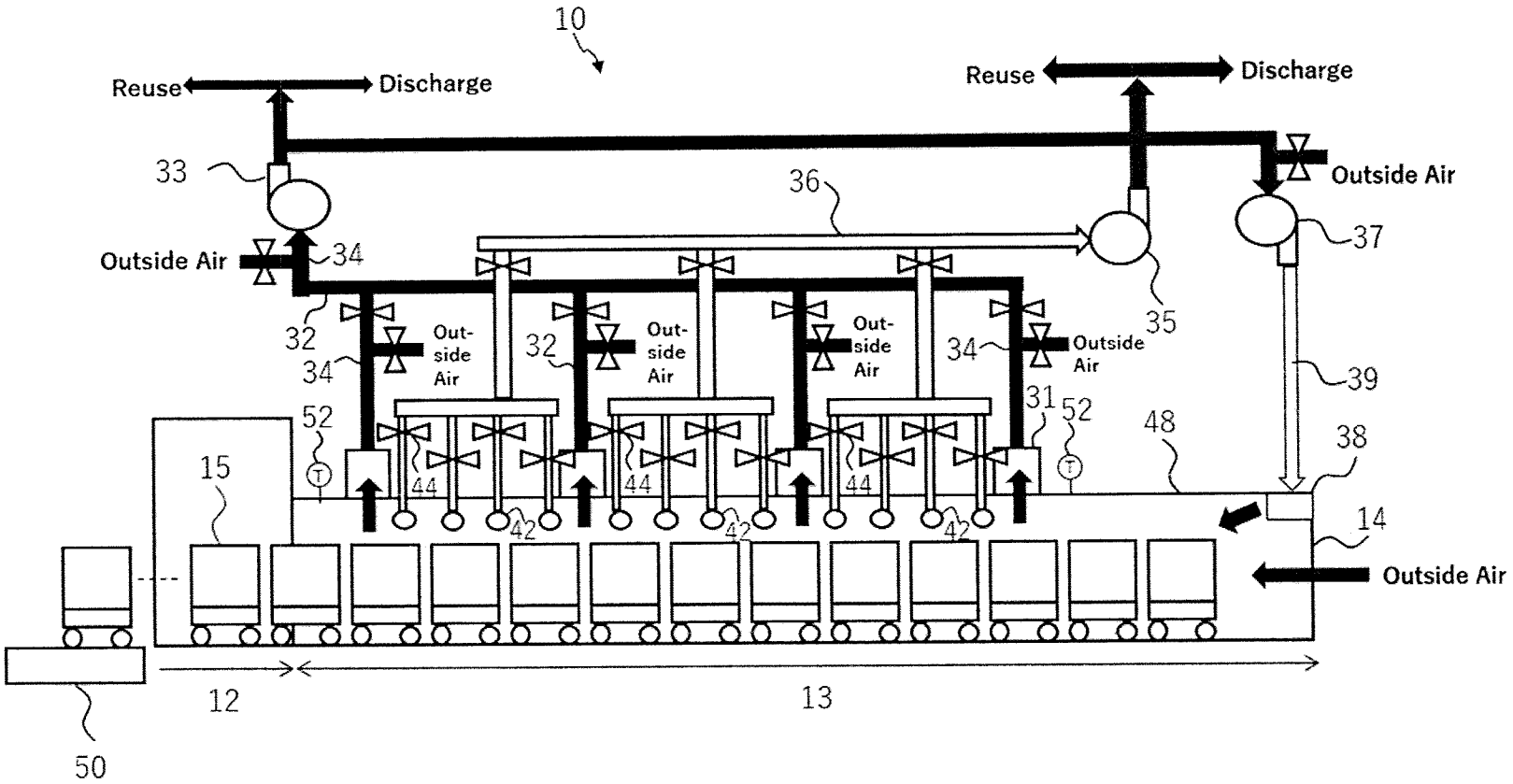

[FIG. 3]
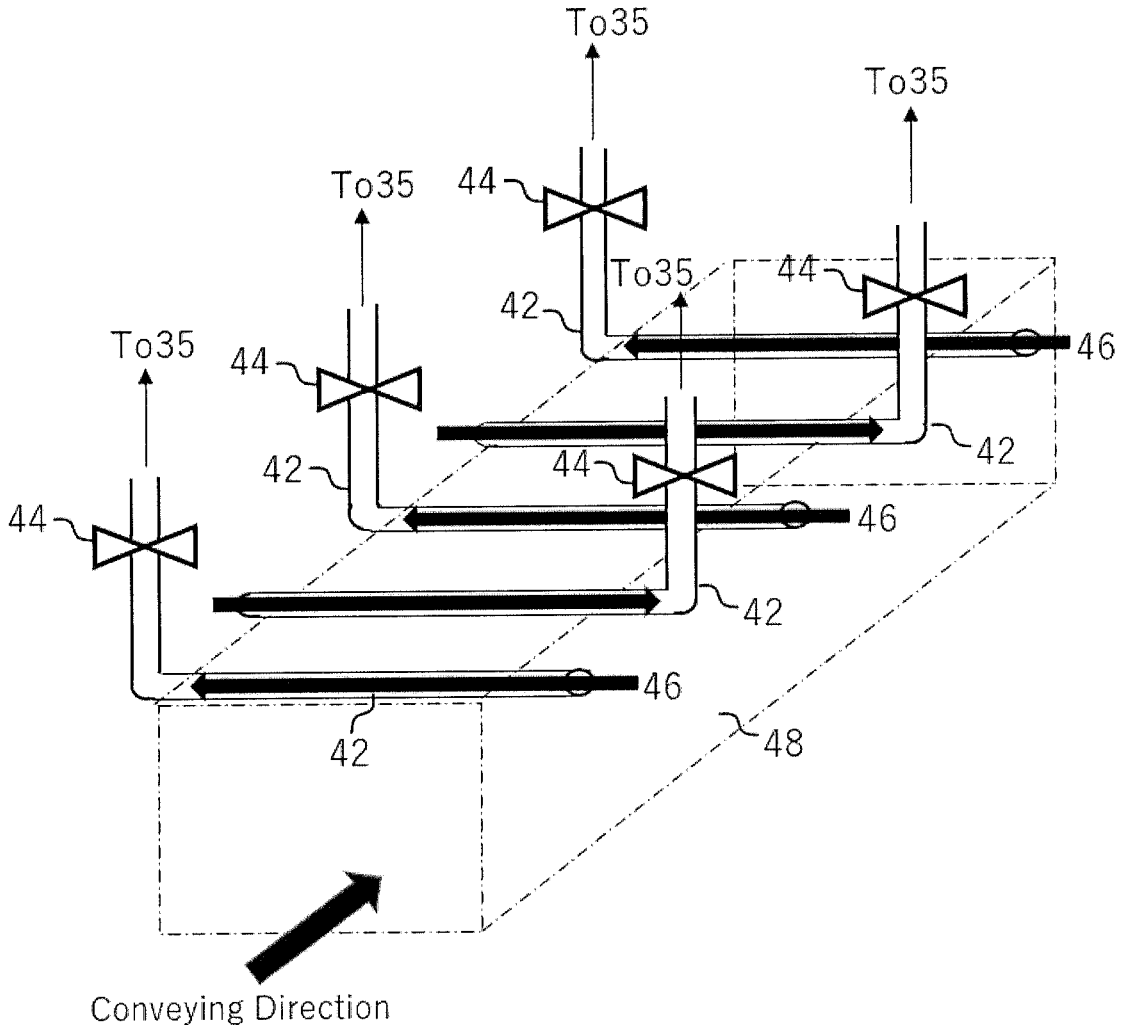

[FIG. 4]
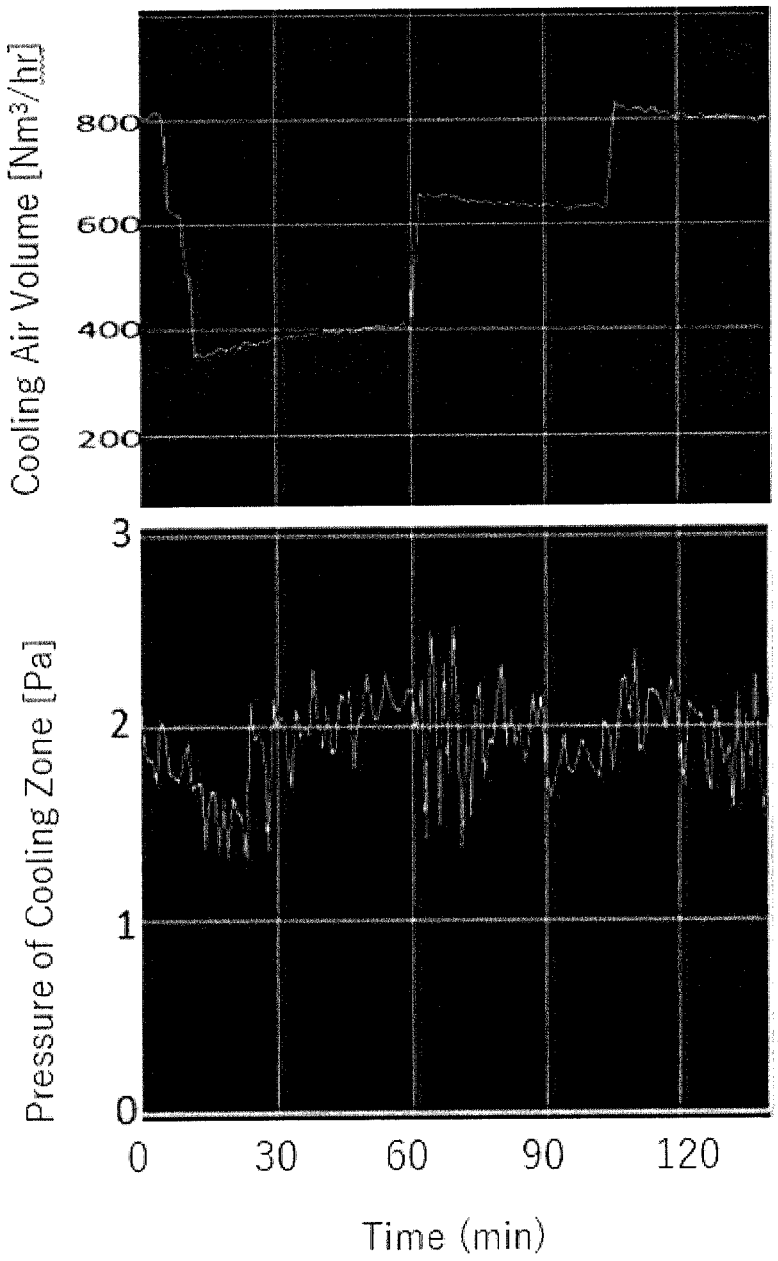

[FIG. 5]
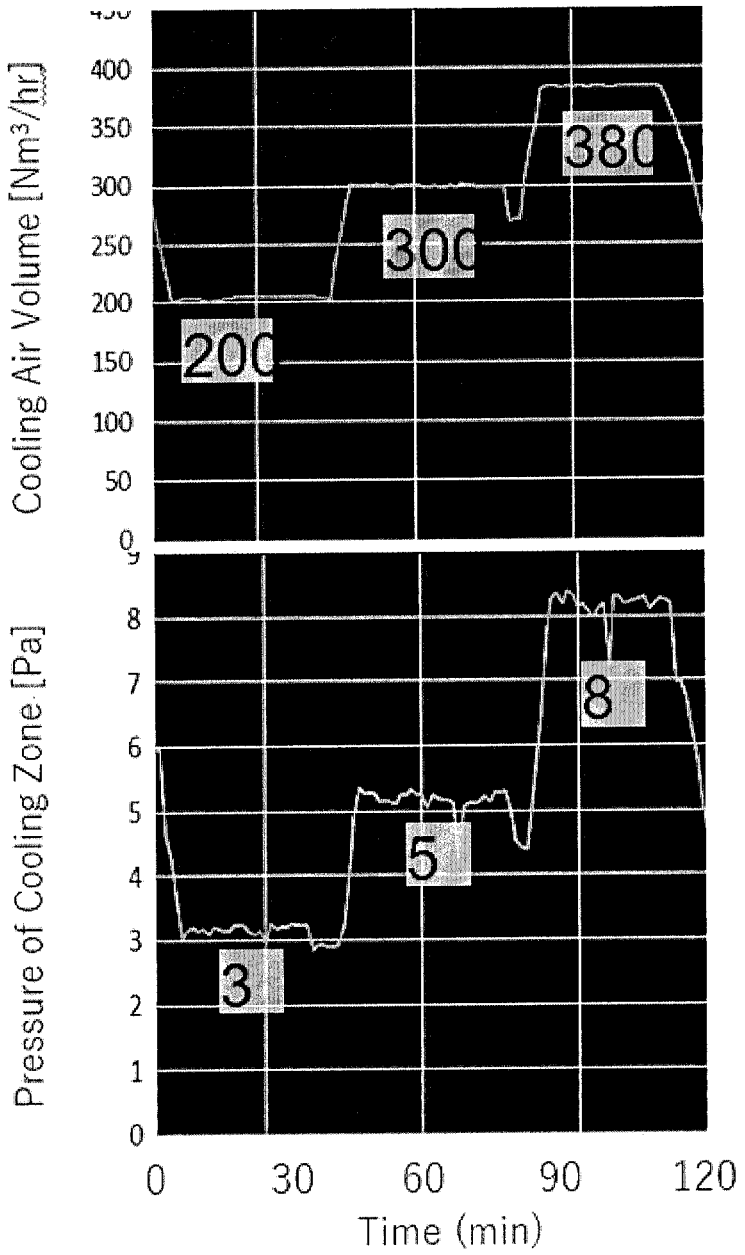

CONTINUOUS HEATING FURNACE AND OPERATING METHOD THEREOF

TECHNICAL FIELD

The present invention relates to a continuous heating furnace. The present invention also relates to a method for operating a continuous furnace.

BACKGROUND ART

A continuous firing furnace for firing ceramic products such as roof tiles, sanitary ware, dishes, and honeycomb structures (e.g., filters and heat exchangers) are operated without intentionally decreasing an oxygen concentration, except for a decrease in oxygen concentration in the furnace due to burner combustion. Therefore, the continuous firing furnace is referred to as an atmospheric firing continuous furnace.

In the atmospheric firing continuous furnace, a pressure in the furnace is adjusted so as to have a pressure of a preheating zone≤a firing zone≤a cooling zone, whereby an in-furnace gas with a temperature increased by cooling a fired product in the cooling zone flows into the firing zone and effectively utilized for firing a workpiece. Further, the in-furnace gas that has flowed from the firing zone having a higher temperature to the preheating zone having a lower temperature is effectively utilized to preheat the workpiece. Thus, in the atmospheric firing continuous furnace, a furnace operating method for saving energy by effectively using heat has been generally implemented.

A cooling mechanism in the atmospheric firing continuous furnace is generally carried out by direct cooling to inject air outside the furnace directly into the furnace as cooling air and exchange the heat with a fired product to cool it (e.g., Japanese Patent No. 2859987; Japanese Patent Application Publication No. H04-124586 A).

There is also known a technique for performing indirect cooling in addition to the direct cooling in the atmospheric firing continuous furnace in order to enhance a heat recovery efficiency (Japanese Patent Publication No. H03-40317 B). This document discloses that by performing the indirect cooling, in addition to cooling by the cooling air that is blown into the cooling zone as in the prior art to cool the fired product in the cooling zone, the heat can be recovered as heated air from the fired product and carriages without affecting an in-furnace pressure balance of the cooling zone. This document also discloses that an increased cooling capacity of the cooling zone facilitates the maintenance of the pressure balance in the cooling zone.

CITATION LIST

Patent Literatures

Patent Document 1: Japanese Patent No. 2859987 B
Patent Document 2: Japanese Patent Application Publication No. H04-124586 A
Patent Document 3: Japanese Patent Publication No. H03-40317 B

SUMMARY OF INVENTION

Technical Problem

The atmospheric firing continuous furnace is highly versatile, and often fires many types of workpieces using the same furnace. However, depending on the workpieces, the weights of the workpieces may be significantly different. Therefore, if a light-weight workpiece passes through the furnace even under the same operation conditions, the cooling capacity is excessive, a heat curve of the cooling zone is lowered (a temperature is decreased), thereby causing a problem that cracking of furnace tools or workpieces due to cooling takes place. On the contrary, if a heavy-weight workpiece passes through the furnace, the heat curve in the cooling zone is significantly increased (a temperature is increased) due to a lack of a cooling capacity to increase a temperature of the workpiece taken out from the furnace, thereby causing a problem that unloading work of workpieces may be disrupted.

However, if an air volume for the direct cooling is increased or decreased in order to maintain a constant heat curve in the cooling zone, a furnace pressure in the cooling zone varies, and the furnace pressure balance among the preheating zone, the firing zone and the cooling zone as described above is lost, so that the flowing of the gas in the furnace is easily disturbed. If the heat curve in the entire furnace is disturbed, a great amount of labor will be required for adjusting the furnace pressure balance. Therefore, conventionally, the heat curve adjustment of the cooling zone cannot be appropriately performed according to the weight of the workpiece, so that the heat curve in the cooling zone often remains varying by the course of nature.

Japanese Patent Publication No. H03-40317B proposes further improvement of the heat recovery efficiency by incorporating the indirect cooling in the cooling zone. However, the invention described in the document is not intended to adjust the heat curve.

The present invention has been created in view of the above circumstances, and an object of the present invention is to provide a continuous heating furnace which can easily adjust the heat curve without losing the furnace pressure balance, in one embodiment. Another object of the present invention is to provide a method for operating such a continuous heating furnace.

Solution to Problem

The invention disclosed in Japanese Patent Application Publication No. H03-40317 B recovers heat by an indirect cooling box located at a position close to an outlet of the cooling zone, and then feeds the heated air from the cooling box to a heat storage cooling type exchanger located at a position close to the firing zone and further recovers the heat. However, in this configuration, the indirect cooling box and the heat storage cooling type exchanger are connected to each other in series, so that the cooling power of the heat storage cooling type exchanger depends on a refrigerant flowing from the indirect cooling box. Therefore, it is difficult to control the cooling capacities of both the indirect cooling box and the heat storage cooling type exchanger independently, and the ability to adjust the heat curve is not enough.

The present inventors have intensively studied to solve the above problems, and found that the heat curve can be easily adjusted without losing the furnace pressure balance, by providing a plurality of indirect coolers with independent regulators each capable of adjusting the cooling power and arranging these indirect coolers in parallel in a conveying direction of the workpiece, in addition to the direct cooling using a gas outside the furnace. The present invention has been completed based on the findings and is illustrated below.

[1]

A continuous heating furnace comprising an inlet, a heating zone, a cooling zone and an outlet in this order, for carrying out a heat treatment while conveying at least one workpiece from the inlet to the outlet, wherein the cooling zone is configured such that an ambient gas for direct cooling of the workpiece can flow into the cooling zone from the outlet;

the cooling zone comprises a plurality of indirect coolers arranged in parallel in the conveying direction of the workpiece, each of the indirect coolers having at least one regulator for independently adjusting a cooling power; and the cooling zone comprises one or more residual heat outlets for discharging a residual heat gas in the cooling zone.

[2]

The continuous heating furnace according to [1] or [2], wherein the cooling zone comprises one or more introducing ports for a cooling gas fed via one or more fans in order to directly cool the workpiece, the introducing ports being disposed between the outlet and the indirect cooler located at a position closest to the outlet among the indirect coolers.

[3]

The continuous heating furnace according to [1], wherein the cooling zone comprises no introducing port for a cooling gas fed via one or more fans in order to directly cool the workpiece at a position closer to inlet than the indirect cooler located at a position closest to the outlet among the indirect coolers.

[4]

The continuous heating furnace according to any one of [1] to [3], wherein each of the indirect coolers comprises at least one regulator capable of adjusting a flow rate of a refrigerant flowing through each of the indirect coolers.

[5]

The continuous heating furnace according to any one of [1] to [4], comprising:

a weight sensor for measuring a weight of the workpiece, and an automatic controller for operating the regulator based on the weight of the workpiece measured by the weight sensor to adjust the cooling power of the indirect cooler.

[6]

The continuous heating furnace according to any one of [1] to [5], comprising:

at least one thermometer for measuring an in-furnace temperature of the cooling zone, and an automatic controller for operating the regulator based on a value of the thermometer to adjust the cooling power of the indirect cooler.

[7]

The continuous heating furnace according to any one of [1] to [6], wherein the continuous heating furnace is a continuous firing furnace.

[8]

A method for operating the continuous heating furnace according to any one of [1] to [7], the method comprising adjusting the cooling power of each of the indirect coolers based on either one or both of a weight of the workpiece and an in-furnace temperature of the cooling zone, without substantially changing a flow rate of the ambient gas flowing from the outlet into the cooling zone or a flow rate of the residual heat gas discharged from the one or more residual heat outlets.

[9]

The method according to [8], wherein the cooling zone comprises one or more introducing ports for a cooling gas fed via one or more fans in order to directly cool the workpiece, the introducing ports being disposed between the outlet and the indirect cooler located at a position closest to the outlet among the indirect coolers; and wherein the method comprises adjusting the cooling power of each of the indirect coolers based on either one or both of a weight of the workpiece and an in-furnace temperature of the cooling zone, without substantially changing a flow rate of the cooling gas fed to the cooling zone.

[10]

The method according to [8] or [9], wherein the cooling power of each of the indirect coolers is adjusted by at least one regulator capable of adjusting a flow rate of a refrigerant flowing through each of the indirect coolers.

[11]

The method according to any one of [8] to [10], wherein the workpiece after passing through the heating zone is made of ceramics, and the cooling power of each of the indirect coolers is adjusted such that a surface temperature of the workpiece is decreased from a temperature more than 600° C. to a temperature less than 600° C., during a process from when the workpiece starts passing through the indirect cooler located at a position closest to the inlet until when the workpiece finishes passing through the indirect cooler located at a position closest to the outlet, among the indirect coolers.

[12]

The method according to [11], wherein the cooling power of each of the indirect coolers is adjusted such that the surface temperature of the workpiece is decreased from a temperature of 800° C. or more to a temperature less than 500° C., during a process from when the workpiece starts passing through the indirect cooler located at the position closest to the inlet until when the workpiece finishes passing through the indirect cooler located at the position closest to the outlet, among the indirect coolers.

[13]

The method according to any one of [8] to [12], wherein a variation in a furnace pressure when the workpiece passes through the cooling zone is 1.5 Pa or less.

Advantageous Effects of Invention

According to the continuous heating furnace according to the present invention, the heat curve can be easily adjusted without losing the furnace pressure balance. Therefore, the heat curve can be adjusted without controlling the furnace pressure, for example even if the type of the workpiece to be fired is changed and the weight of the workpiece varies, thereby enabling a risk of generating cracks due to cooling in the fired product to be reduced.

BRIEF DESCRIPTION OF DRAWINGS

FIG. 1 is a schematic view showing an entire structure of a continuous heating furnace according to an embodiment of the present invention.

FIG. 2 is a schematic view showing a structure of a cooling zone in a continuous heating furnace according to an embodiment of the present invention.

FIG. 3 is a schematic view showing an example of a method for arranging a plurality of indirect coolers.

FIG. 4 is graphs showing a cooling air volume and a furnace pressure of a cooling zone over time in Examples.

FIG. 5 is graphs showing a cooling air volume and a furnace pressure of a cooling zone over time in Comparative Examples.

DESCRIPTION OF THE PREFERRED EMBODIMENTS

Embodiment for carrying out the present invention will be now described in detail with reference to the drawings. It should be understood that the present invention is not limited to the following embodiments, and appropriate design changes, improvements, and the like may be added based on the ordinary knowledge of those skilled in the art without departing from the spirit of the present invention.

<1. Entire Structure>

FIG. 1 is a schematic view showing an entire structure of a continuous heating furnace (10) according to an embodiment of the present invention. The continuous heating furnace (10) according to the present embodiment includes: an inlet (11); a heating zone (12); a cooling zone (13); and an outlet (14) in this order, and can heat workpieces (not shown) loaded on carriages (15) while conveying the workpieces from the inlet (11) to the outlet (14).

The heating zone refers to a range of a workpiece traveling direction from the inlet of the continuous heating furnace to a heating apparatus located at a position closest to the outlet for heating the inside of the furnace. The cooling zone refers to a range of the workpiece traveling direction from a position immediately after the heating apparatus located at the position closest to the outlet to the outlet of the continuous furnace. The concept of "heating" encompasses "firing". When producing a ceramic product, the heating zone (12) can be divided into a preheating zone (12*a*) where removal of a binder is performed and a firing zone (12*b*) where firing is performed.

The workpiece is an article undergoing the heat treatment, including, but not particularly limited to, for example, electronic components such as ferrite and a ceramic capacitor, semiconductor products, ceramic products, potteries, refractory oxides, glass products, metal products, and carbon refractories such as alumina-graphite and magnesia-graphite. When heating the workpiece at 1000° C. or more, typically 1200° C. or more, more typically 1400° C. or more, for example from 1000 to 2000° C., the continuous heating furnace according to the present invention can be suitably used.

The type of continuous heating furnace is not particularly limited. For example, it can be a tunnel kiln, a roller hearth kiln and a pusher kiln. Further, the continuous heating furnace is typically an atmospheric firing furnace, which burns a fuel in a state where an m value (a ratio of actual combustion air amount to theoretical air amount) is 1.0 or more.

<2. Cooling Zone>

FIG. 2: is a schematic view showing a structure of the cooling zone (13) in the continuous heating furnace (10) according to one embodiment of the present invention. The cooling zone (13):

- is configured such that an ambient gas for direct cooling of the workpiece can flow into the cooling zone (13) from the outlet (14);
- includes a plurality of indirect coolers (42) arranged in parallel in the conveying direction of the workpiece, each of the indirect coolers having at least one regulator (44) for independently adjusting a cooling power; and
- includes one or more residual heat outlets (31) for discharging a residual heat gas in the cooling zone (13).

The cooling zone (13) is configured to allow the ambient gas for directly cooling the workpiece to flow into the cooling zone from the outlet (14). The ambient gas is typically air, preferably outside air. By configuring the ambient gas to flow from the outlet (14) into the cooling zone, the pressure in the furnace can be adjusted such that the pressure of the heating zone≤the pressure of the cooling zone, and the ambient gas flowing into the cooling zone (13) can flow towards the inlet (11). The inlet (11) side is provided with an exhaust port (not shown), from which the furnace gas is sucked and exhausted. This can allow a thermal energy of the in-furnace gas that has increased the temperature by recovering the thermal energy in the cooling zone can be utilized in the heating zone, so that a heat utilization efficiency is improved.

The cooling zone (13) also includes a plurality of indirect coolers (42) arranged in parallel in the conveying direction of the workpiece. The structure of each indirect cooler (42) is not particularly limited, and it may have, for example, a jacket structure or a pipe structure. A refrigerant can flow through each indirect cooler (42). Each indirect cooler (42) is in communication with an indirect cooling exhaust fan (35) via an indirect cooling exhaust duct (36), and the refrigerant receives heat from the in-furnace gas while flowing through each indirect cooler (42), and is then discharged through the indirect cooling exhaust duct (36) by suction force of the indirect cooling exhaust fan (35). The indirect cooling exhaust fan (35) and the indirect cooling exhaust duct (36) may be provided for each indirect cooler (42), but in view of cost reduction, a plurality of indirect cooling exhaust fans (35) and a plurality of indirect cooling exhaust ducts (36) may be appropriately merged to discharge the refrigerant from a common indirect cooling exhaust duct (36). The refrigerant discharged from the indirect cooling exhaust fan (35) may be discharged to the atmosphere, or may be reused as a heat source for combustion air or preheating of the workpiece. Alternatively, the refrigerant may be heated by means of a heat exchanger or the like to recycle it as a refrigerant for the cooling zone (13).

In the present embodiment, it is assumed that air is used as the refrigerant, but the refrigerant is not limited to air, for example, a gas such as $N_2$ and Ar, or a liquid such as water may be used.

Each indirect cooler (42) has at least one regulator (44) for independently adjusting the cooling power. The indirect cooling does not change a flow rate of the in-furnace gas by increasing or decreasing the cooling power, and therefore does not affect the furnace pressure balance. Further, since each indirect cooler (42) is provided with the independent cooling capacity regulator (44), the controllability of the heat curve is improved. For example, the cooling zone (13) can be optionally divided into a plurality of zones according to temperature ranges, and the cooling power of the indirect cooler (42) can be independently adjusted for each zone.

The regulator (44) is not particularly limited as long as it can individually adjust the cooling power of each indirect cooler (42), including, for example, flow rate controllers such as a damper and a valve that can adjust the flow rate of the refrigerant flowing through each indirect cooler, as the regulator. Further, it is also possible to use refrigerant feeders such as a fan and a pump having an inverter capable of controlling a rotational speed of a motor, as the regulator (44).

The cooling power of each indirect cooler (42) can be adjusted depending on the weight of the workpiece. For example, the heat curve can be controlled by adjusting each regulator (44) such that the cooling power is higher for a heavy workpiece and the cooling power is lower for a light workpiece. The adjustment of the cooling power of each indirect cooler may be manual control or automatic control. For the automatic control, in one embodiment, the continuous heating furnace includes: a weight sensor (50) for measuring the weight of the workpiece; and an automatic controller that operates each regulator based on the weight of the workpiece measured by the weight sensor (50) to adjust the cooling power of each indirect cooler. For example, if the regulator is a motor-driven damper or valve, the opening degree of them can be controlled by a controller.

The cooling power of each indirect cooler (42) can also be adjusted according to a value of one or more thermometers (52) located in the cooling zone (13). For example, a plurality of thermometers are located in the cooling zone along the conveying direction, the cooling zone is divided into a plurality of zones, a target value is set for each zone, and the cooling power can be adjusted such that the cooling power of the indirect cooler located in the zone gets lower when the value of the thermometer is below a certain target value, and the cooling power of the indirect cooler located in the zone gets higher when the value of the thermometer is above the target value. Also in this case, the adjustment of the cooling power of each indirect cooler may be manual control or automatic control.

The indirect coolers (42) are arranged in parallel, and the refrigerant that has passed through one indirect cooler (42) is discharged to the outside of the furnace without passing through the other indirect cooler (42) in the cooling zone. With this configuration, each indirect cooler (42) does not use the refrigerant that has recovered heat with the other indirect cooler (42), so that the controllability of the heat curve is improved. Conversely, if the indirect coolers (42) are connected in series, the indirect coolers have a lower degree of freedom in controlling the cooling power toward the downstream side, so it is difficult to adjust the cooling power of each indirect cooler (42) independently.

FIG. 3 shows an example of a method for arranging a plurality of indirect coolers (42). In FIG. 3, each indirect cooler (42) has a pipe structure and is configured to penetrate both sides of a furnace wall (48) in the cooling zone. The indirect coolers (42) are arranged in parallel along the workpiece conveying direction indicated by the arrow in the figure. Each indirect cooler (42) is individually provided with a refrigerant flow rate controller (44) such as a damper. The refrigerant may flow through the furnace in the same direction among the indirect coolers (42), but in view of providing an uniform temperature distribution of the gas in a right-left direction orthogonal to the conveying direction, it is preferable at least one indirect cooler (42) in which the refrigerant flows in the opposing direction be provided, and it is more preferable the indirect coolers (42) in which the flow directions of the refrigerant be opposite to each other are alternately arranged in the conveying direction.

Referring to FIG. 2, one or more residual heat outlets (31) may be disposed in a furnace wall (48) of the cooling zone (13). Each residual heat outlet (31) is in communication with the residual heat exhaust fan (33) via the residual heat exhaust duct (32), and can discharge a part of the in-furnace gas in the cooling zone (13) from each residual heat outlet (31) by the suction power of the residual heat exhaust fan (33). The extracting of the in-furnace gas from the cooling zone (13) facilitates the control the heat curve in the cooling zone. An outside air introducing port (34) may be provided in the middle of the residual heat exhaust duct (32), whereby the temperature of the gas flowing through the residual heat exhaust duct (32) can be adjusted.

The cooling zone (13) may include one or more introducing ports (38) for a cooling gas to directly cool the workpiece, between the outlet (14) and the indirect cooler (42) located at a position closest to the outlet (14), among the indirect coolers (42). The cooling gas may be fed through an outlet introducing duct (39) by sucking air (typically outside air) from one or more outlet introducing fans (37) and. The gas discharged from the residual heat exhaust fan (33) may be circulated and used as a cooling gas introduced at the outlet. The cooling gas introduced into the furnace from each cooling gas introducing port (38) can be used for direct cooling of the workpiece. Non-limiting examples of the temperature of the cooling gas introduced at the outlet may be from 60 to 100° C.

In general, the continuous heating furnace (10) is constructed by connecting a plurality of can bodies, and the introducing port (38) is preferably disposed at the can body closest to the outlet (14) or at the can body that is closest to the outlet but one. Near the outlet, the temperature of the workpiece is sufficiently lowered, and there is substantially no risk that cracking occurs even if it is directly cooled. Rather, the direct cooling near the outlet is more advantageous because the furnace pressure balance between the heating zone (12) and the cooling zone (13) can be adjusted.

On the other hand, in the region of the cooling zone where the indirect coolers are disposed, the temperature of the workpiece is relatively high, and the direct cooling may cause cracking due to overcooling. For this reason, preferably, the cooling zone is not provided with any introducing port for the cooling gas fed via one or more fans to directly cool the workpiece at a position closer to the inlet than the indirect cooler located at a position closest to the outlet among the indirect coolers.

<3. Operating Method>

In one embodiment, the present invention provides a method for operating the continuous furnace as described above. In one embodiment, the method for operating the continuous heating furnace includes adjusting the cooling power of each of the indirect coolers (42) based on the weight of the workpiece, without substantially changing a flow rate of the ambient gas flowing from the outlet (14) into the cooling zone or a flow rate of the residual heat gas discharged from the one or more residual heat outlets (31).

If the cooling power in the cooling zone (13) is the same, a weight change of the workpiece changes the heat curve since a heat capacity of the workpiece is changed. In order to maintain the heat curve, it is desired that the cooling power in the cooling zone (13) be changed according to the weight change of the workpiece. According to the present embodiment, neither the flow rate of the ambient gas flowing through the cooling zone from the outlet (14) nor the flow rate of the residual heat gas discharged from the one or more residual heat outlets (31) is substantially changed, so the furnace pressure balance is not lost. Further, the indirect coolers are arranged in parallel in the conveying direction and each has at least one regulator for independently adjusting the cooling power, so the cooling power of these indirect coolers can be adjusted to control the heat curve easily.

Therefore, in one embodiment of the method for operating the continuous heating furnace according to the present invention, the variation in the furnace pressure when the workpiece passes through the cooling zone can be 1.5 Pa or less, and preferably 1.0 Pa or less.

The same applies to the case where the cooling zone (13) is provided with one or more introducing ports (38) for the cooling gas to cool the workpiece directly. The cooling power of each of the indirect coolers can be respectively adjusted based on the weight of the workpiece without substantially changing the flow rate of the cooling gas fed to the cooling zone.

In addition to or instead of the weight of the workpiece, the adjustment of the cooling power of each of the indirect coolers (42) may be performed based on the in-furnace temperature of the cooling zone. Therefore, in another embodiment, the method for operating the continuous heating furnace includes adjusting the cooling power of each of the indirect coolers (42) based on the value of one or more thermometers located in the cooling zone, without substantially changing the flow rate of the ambient gas flowing in the cooling zone from the outlet (14) or the flow rate of residual heat gas discharged from the one or more residual heat outlets (31).

The same applies to the case where the cooling zone (13) is provided with one or more introducing ports (38) for the cooling gas to cool the workpiece directly. The cooling power of the indirect coolers can be respectively adjusted based on the value of one or more thermometers located in the cooling zone without substantially changing the flow rate of the cooling gas fed to the cooling zone.

The phrase "without substantially changing the flow rate of the ambient gas, residual heat gas or cooling gas" means that any operation for artificially and intentionally changing these flow rates are not carried out, such as changing the opening degree of the damper and changing the rotational speed of the fan. In general, these flow rates vary, so they may vary within ±10% or less from the average value, even if they are not intentionally changed.

When the workpiece after passing through the heating zone is made of ceramics, cracking tends to occur due to overcooling if the workpiece is directly cooled for the workpiece having a temperature of about 600° C. For example, the cracking tends to occur at about 600° C. for SiC and at about 570° C. for cordierite. Therefore, the cooling power of each of the indirect coolers is preferably adjusted such that a surface temperature of the workpiece is decreased from a temperature more than 600° C. to a temperature less than 600° C., desirably from a temperature of 800° C. or more to a temperature of 500° C. or less, during a process from when the workpiece starts passing through the indirect cooler located at a position closest to the inlet until when the workpiece finishes passing through the indirect cooler located at a position closest to the outlet, among the indirect coolers.

An example of operation procedures of the continuous heating furnace according to the present invention is illustrated.

Initial adjustment is carried out in a state where the quantity of the workpieces is at a presumed minimum level. In this case, each of the indirect coolers is in a stopped or minimum output state.

The outlet introducing fan is activated, as well as the residual heat exhaust fan is activated, whereby the heat curve of the cooling zone is adjusted to the target state. Subsequently, in a state where the amount of workpieces is increased, the cooling power (for example, the opening degree of the damper) of each of the indirect coolers is adjusted so as to gain the target heat curve, without changing the outputs of the residual heat exhaust fan or the outlet introducing fan.

EXAMPLES

Hereinafter, while Examples for illustrating the present invention and its advantages will be described in more detail, but the present invention is not limited to the Examples.

Example

The continuous heating furnace having the structure shown in FIG. 1 was provided with the indirect coolers each having the structure shown in FIG. 2, and an operation for heating and cooling the workpieces was actually performed. The detailed operating conditions are as follows:

(1) Type of Furnace: a tunnel type atmospheric firing furnace (a furnace length of 100 m, and an in-furnace width of 2.5 m);

(2) Workpieces: cylindrical honeycomb formed products (changed in a range of φ80 to 150 mm×height of 70 to 160 mm);

(3) Number of Workpieces per Carriage: from 150 to 648;

(4) Indirect Cooling Conditions:

- Refrigerant: air at about 10 to 40° C.;
- Structure of Each Indirect Cooler: ceramic pipe structure having an outer diameter of 40 mm and a wall thickness of 5 mm;
- Disposed Position of Indirect Cooler: disposed at a position of 200 mm from the furnace wall ceiling so as to penetrate both sides of the furnace wall in the direction perpendicular to the workpiece conveying direction (see FIG. 3);
- Arrangement of Indirect Coolers: 49 indirect coolers were arranged in parallel at an interval of 100 mm along the workpiece conveying direction;
- Flow Direction of Refrigerant: flows of the refrigerant flowing through the furnace in the adjacent indirect coolers were in directions opposite to each other;
- Flow Rate Control Method: a damper was disposed for each indirect cooler;
- Flow Rate of Refrigerant (Total flow rate flowing through a plurality of indirect coolers): gradual change; 800 $Nm^3/hr \rightarrow 400\ Nm^3/hr \rightarrow 620\ Nm^3/hr \rightarrow 800\ Nm^3/hr$;
- In-Furnace Temperature Region of Cooling Zone Which Performed Indirect Cooling: a region which was decreased from about 800° C. to 500° C.;

(5) Direct Cooling Conditions:

Outside Air Introduced from Outlet of Furnace: from 200 to 400 $Nm^3/hr$; and Cooling Air from Outlet Introducing Fan: from 200 to 500 $Nm^3/hr$ (air at about 10 to 40° C.).

The results are shown in FIG. 4. The upper graph of FIG. 4 shows a change of a flow rate of the refrigerant flowing through the indirect coolers for the cooling zone (which flow rate refers to a cooling air volume) over time, when changing the cooling air volume by adjusting the opening degree of the damper during operation of the continuous heating furnace according to Example. The lower graph of FIG. 4 shows a change of a furnace pressure (relative pressure) of the cooling zone over time, when changing the cooling air volume as shown in the upper graph. As can be seen from FIG. 4, the variation in the furnace pressure of the cooling zone was about 1 Pa, and the furnace pressure of the cooling zone was not affected by the change of the cooling air volume.

Further, the cooling air volume flowing through each indirect cooler was changed according to the values of the in-furnace thermometers disposed in the cooling zone, and the continuous heating furnace was operated so as to maintain a predetermined heat curve of the cooling zone to fire 5000 or more workpieces having various weights. As a result, no cracking of the workpieces occurred.

Comparative Example

In the continuous heating furnace used in Example, the operation for heating and cooling the workpieces was carried out under the same conditions as those of Example, with the exception that the cooling air was blown into the cooling zone using direct coolers in place of the indirect coolers. The conditions for direct cooling of the cooling zone are as follows:

Refrigerant: air;

Arrangement of Direct Coolers: four direct coolers were arranged at an interval of 1500 mm along the workpiece conveying direction;

Disposed Position of Direct Cooler: the introducing ports were arranged such that the cooling air was blown from the furnace wall ceiling;

Flow Rate Control Method: a damper was disposed for each direct cooler;

Flow Rate of Refrigerant (Total flow rate flowing through a plurality of direct coolers): gradual change; 200 $Nm^3/hr \rightarrow 300\ Nm^3/hr \rightarrow 380\ Nm^3/hr$; and In-Furnace Temperature Region of Cooling Zone Which Performed Direct Cooling: a region which was decreased from about 800° C. to 500° C.

The results are shown in FIG. 5. The upper graph of FIG. 5 shows a change of a flow rate of the refrigerant blown into the cooling zone through the direct coolers (which flow rate refers to a cooling air volume) over time, when changing the cooling air volume by adjusting the opening degree of the damper during operation of the continuous heating furnace according to Comparative Example. The lower graph of FIG. 5 shows a change of a furnace pressure (relative pressure) of the cooling zone over time, when changing the cooling air volume as shown in the upper graph. As can be seen from FIG. 5, the furnace pressure of the cooling zone was significantly affected by the change of the cooling air volume.

Further, 1000 workpieces having various weights were fired using the continuous heating furnace. In this case, the cooling air volume of the cooling zone was constant regardless of the weights of the workpieces. As a result, microcracks occurred for about 20% of the workpieces.

DESCRIPTION OF REFERENCE NUMERALS

10 continuous heating furnace
11 inlet
12 heating zone
13 cooling zone
14 outlet
15 carriage
32 residual heat exhaust duct
31 residual heat outlet
33 residual heat exhaust fan
34 outside air introducing port
35 indirect cooling exhaust fan
36 indirect cooling exhaust duct
37 outlet introducing fan
38 cooling gas introducing port
42 indirect cooler
44 regulator (flow rate controller)
46 refrigerant
48 furnace wall
50 weight sensor
52 thermometer

What is claimed is:

1. A continuous heating furnace comprising an inlet, a heating zone, a cooling zone and an outlet in this order, for carrying out a heat treatment while conveying at least one workpiece from the inlet to the outlet, wherein the cooling zone is configured such that an ambient gas for direct cooling of the workpiece can flow into the cooling zone from the outlet;

the cooling zone comprises a plurality of indirect coolers arranged in parallel in the conveying direction of the workpiece, each of the indirect coolers having at least one regulator for independently adjusting a cooling power; and the cooling zone comprises one or more residual heat outlets for discharging a residual heat gas in the cooling zone.

2. The continuous heating furnace according to claim 1, wherein the cooling zone comprises one or more introducing ports for a cooling gas fed via one or more fans in order to directly cool the workpiece, the introducing ports being disposed between the outlet and the indirect cooler located at a position closest to the outlet among the indirect coolers.

3. The continuous heating furnace according to claim 1, wherein the cooling zone comprises no introducing port for a cooling gas fed via one or more fans in order to directly cool the workpiece at a position closer to the inlet than the indirect cooler located at a position closest to the outlet among the indirect coolers.

4. The continuous heating furnace according to claim 1, wherein each of the indirect coolers comprises at least one regulator capable of adjusting a flow rate of a refrigerant flowing through each of the indirect coolers.

5. The continuous heating furnace according to claim 1, comprising:

a weight sensor for measuring a weight of the workpiece, and an automatic controller for operating the regulator based on the weight of the workpiece measured by the weight sensor to adjust the cooling power of the indirect cooler.

6. The continuous heating furnace according to claim 1, comprising:

at least one thermometer for measuring an in-furnace temperature of the cooling zone, and an automatic controller for operating the regulator based on a value of the thermometer to adjust the cooling power of the indirect cooler.

7. The continuous heating furnace according to claim 1, wherein the continuous heating furnace is a continuous firing furnace.

8. A method for operating the continuous heating furnace according to claim 1, the method comprising adjusting the cooling power of each of the indirect coolers based on either one or both of a weight of the workpiece and an in-furnace temperature of the cooling zone, without substantially changing a flow rate of the ambient gas flowing from the outlet into the cooling zone or a flow rate of the residual heat gas discharged from the one or more residual heat outlets.

9. The method according to claim 8, wherein the cooling zone comprises one or more introducing ports for a cooling gas fed via one or more fans in order to directly cool the workpiece, the introducing ports being disposed between the outlet and the indirect cooler located at a position closest to the outlet among the indirect coolers; and wherein the method comprises adjusting the cooling power of each of the indirect coolers based on either one or both of a weight of the workpiece and an in-furnace temperature of the cooling zone, without substantially changing a flow rate of the cooling gas fed to the cooling zone.

10. The method according to claim 8, wherein the cooling power of each of the indirect coolers is adjusted by at least one regulator capable of adjusting a flow rate of a refrigerant flowing through each of the indirect coolers.

11. The method according to claim 8, wherein the workpiece after passing through the heating zone is made of ceramics, and the cooling power of each of the indirect coolers is adjusted such that a surface temperature of the workpiece is decreased from a temperature more than 600° C. to a temperature less than 600° C., during a process from when the workpiece starts passing through the indirect cooler located at a position closest to the inlet until when the workpiece finishes passing through the indirect cooler located at a position closest to the outlet, among the indirect coolers.

12. The method according to claim 11, wherein the cooling power of each of the indirect coolers is adjusted such that the surface temperature of the workpiece is decreased from a temperature of 800° C. or more to a temperature less than 500° C., during a process from when the workpiece starts passing through the indirect cooler located at the position closest to the inlet until when the workpiece finishes passing through the indirect cooler located at the position closest to the outlet, among the indirect coolers.

13. The method according to claim 8, wherein a variation in a furnace pressure when the workpiece passes through the cooling zone is 1.5 Pa or less.

* * * * *